US007832997B2

(12) United States Patent
Williamson et al.

(10) Patent No.: US 7,832,997 B2
(45) Date of Patent: Nov. 16, 2010

(54) VARIABLE CAPACITY GEROTOR PUMP

(75) Inventors: Matthew Williamson, Richmond Hill (CA); David R. Shulver, Richmond Hill (CA)

(73) Assignee: MAGNA Powertrain, Inc., Concord, ON (CA)

( * ) Notice: Subject to any disclaimer, the term of this patent is extended or adjusted under 35 U.S.C. 154(b) by 629 days.

(21) Appl. No.: 11/720,556

(22) PCT Filed: Dec. 21, 2005

(86) PCT No.: PCT/CA2005/001941

§ 371 (c)(1),
(2), (4) Date: May 31, 2007

(87) PCT Pub. No.: WO2006/066403

PCT Pub. Date: Jun. 29, 2006

(65) Prior Publication Data

US 2008/0166251 A1 Jul. 10, 2008

(51) Int. Cl.
*F01C 1/02* (2006.01)

(52) U.S. Cl. ..... 418/61.3; 418/21

(58) Field of Classification Search ..... 418/61.3
See application file for complete search history.

(56) References Cited

U.S. PATENT DOCUMENTS 1,486,682 A * 3/1924 Phillips ..... 418/2
2,293,126 A * 8/1942 Fersing ..... 418/21
2,484,789 A * 10/1949 Hill et al. ..... 418/21
2,526,830 A * 10/1950 Purcell ..... 417/323
3,687,578 A * 8/1972 White et al. ..... 418/21
3,805,526 A * 4/1974 Charron ..... 60/487
4,618,018 A * 10/1986 Toshimitsu et al. ..... 180/422
4,740,142 A * 4/1988 Rohs et al. ..... 418/21
4,812,111 A 3/1989 Thomas
4,872,536 A * 10/1989 Yue ..... 188/290
4,887,956 A 12/1989 Child
4,932,504 A * 6/1990 Zheng ..... 188/290
5,674,059 A * 10/1997 Bucur ..... 418/28
6,244,839 B1 * 6/2001 Cole et al. ..... 418/21

(Continued)

FOREIGN PATENT DOCUMENTS

WO WO 2004/057191 A1 7/2004

*Primary Examiner*—Thomas Denion
*Assistant Examiner*—Douglas J. Duff
(74) *Attorney, Agent, or Firm*—Harness, Dickey & Pierce, P.L.C.

(57) ABSTRACT

A variable capacity gerotor pump includes an inner rotor that is axially displaceable with respect to the outer rotor to vary the volumetric capacity of the pump. An active piston abuts the lower surface of the inner rotor and can ride inside the outer rotor, as the inner rotor is axially displaced, to provide the necessary scaling of the lower surface of the inner rotor with respect to the outer rotor. A passive piston, against which a return spring acts, abuts the upper surface of the inner rotor to provide the necessary sealing of the upper surface of the inner rotor with respect to the outer rotor. In an embodiment, a control chamber, supplied with pressurized working fluid, generates a force acting against the force of the return spring to move the inner rotor to reduce the volumetric capacity of the pump. In another embodiment, a control mechanism, such as an electric solenoid or mechanical mechanism, acts on the control piston against the force of the return spring.

19 Claims, 6 Drawing Sheets

U.S. PATENT DOCUMENTS 6,283,735 B1 * 9/2001 Schreiber et al. ..... 418/21
7,137,798 B2 * 11/2006 Gotschhofer ..... 418/206.1
7,179,070 B2 * 2/2007 O'Brien, II ..... 418/206.1
7,195,467 B2 * 3/2007 Cadeddu ..... 418/21
7,588,431 B2 * 9/2009 O'Brien, II ..... 418/206.1
2002/0076344 A1 6/2002 Clarke

* cited by examiner

VARIABLE CAPACITY GEROTOR PUMP

FIELD OF THE INVENTION

The present invention relates to a gerotor pump. More specifically, the present invention relates to a gerotor (generated rotor) pump of the type having an inner rotor with a given number of lobes and an outer rotor with one additional lobe wherein the volumetric capacity of the pump can be varied in operation.

BACKGROUND OF THE INVENTION

Gerotor pumps of the type having an inner rotor with a given number of lobes and an outer rotor with one additional lobe, are well known and include rotor assemblies of, without limitation, trochoidal, cycloidal, duo IC, duocentric, parachoid and other designs. Gerotor pumps are used in a variety of applications, such as engine and transmission oil pumps, and electrically driven gasoline pumps for automobiles. While gerotor pumps are widely used and provide good price/performance characteristics, in many applications, such as in oil pumps for internal combustion engines, gerotor pumps do suffer from a disadvantage in that it is not easy to alter their volumetric capacity. Accordingly, to obtain an equilibrium operating pressure in such applications, gerotor pump systems. typically have a pressure relief valve to limit the pressure of the working fluid supplied from the pump.

While such pressure relief valves do allow gerotor pump systems to achieve an equilibrium pressure, the volumetric capacity of the pump is not changed and thus the energy consumed by the pump continues to increase with the pump operating speed even after the equilibrium pressure is reached. Thus, energy from the engine is wasted when the pressure relief valve is diverting excess flow produced by the pump.

Published PCT Patent application WO 2004/057191 to Schneider teaches a variable volume gerotor pump wherein a rotatable adjusting ring has the outer rotor of the pump rotor assembly eccentrically mounted therein. By rotating the adjustment ring relative to the inlet and outlet ports, the volumetric capacity of the pump can be changed. While the Schneider reference does teach a variable volumetric capacity gerotor pump, the Schneider mechanism is complex, requiring a large number of parts, thus increasing the cost of the pump, and the pump is quite large in its radial dimensions which precludes its use in many circumstances.

Another variable volume gerotor pump is taught in U.S. Pat. No. 4,887,956 to Child, and in this pump, the inner rotor meshes with an axially adjacent pair of outer rotors. By altering the alignment of the two outer rotors, the volumetric capacity of the pump can be altered.

Published PCT Application WO 93/21443 to Hodge teaches another variable volume gerotor pump somewhat converse to the pump taught by Child. In the Hodge pump, two axially adjacent inner rotors turn in a single outer rotor. The volumetric capacity of the pump is altered by changing the alignment of the two inner rotors.

While Child and Hodge do teach variable capacity gerotor pumps, the resulting pumps are quite complex, as are the control mechanisms to vary the capacity. Further, the torque on the control shaft of each pump can be non-linear relative to the rotation angle, making it difficult to establish an equilibrium operating pressure.

U.S. Pat. No. 2,484,789 to Hill and subsequent similar patents provide various designs for a variable capacity gerotor pump where the inner rotor moves axially relative to the outer rotor, or vice versa, the volumetric capacity being dependent on the amount of overlap between the two rotors. A major disadvantage of these designs is that the sealing plates at each end of the rotor pair are shaped to mesh inversely with the rotor teeth and they rotate with the rotors. The pump inlet and outlet flows must therefore be fed to and from the rotors using a complex route such as a series of holes in one of the sealing plates and a distributor system, or radial holes in the outer rotor. Any such method is likely to restrict the inlet flow and lead to early onset of cavitation, which is probably one reason why such pump designs are not in common usage.

SUMMARY OF THE INVENTION

It is an object of the present invention to provide a novel variable capacity gerotor pump which obviates or mitigates at least one disadvantage of the prior art.

According to a first aspect of the present invention, there is provided a variable capacity gerotor pump, comprising: a pump body comprising a housing and a cover defining a pump chamber, a pump inlet and a pump outlet; an inner rotor; an outer rotor rotatably located within the pump body, the inner rotor located within the outer rotor and the lobes of the inner rotor and outer rotor engaging without dead volume therebetween when fully engaged; a drive shaft engaging the inner rotor to rotate the inner rotor and the outer rotor when the drive is rotated, the inner rotor being axially displaceable along the drive shaft to alter the volumetric capacity of the pump; non-rotating sealing surfaces acting between the inner rotor and the outer rotor and the pump body to create a high pressure region at the pump outlet and a low pressure region at the pump inlet when the drive shaft is rotated; and a return spring biasing the inner rotor to a position of axial alignment with the outer rotor.

The present invention provides a variable capacity gerotor pump which includes an inner rotor that is axially displaceable with respect to the outer rotor to vary the volumetric capacity of the pump. An active piston abuts the lower surface of the inner rotor and can ride inside the outer rotor, as the inner rotor is axially displaced, to provide the necessary sealing of the lower surface of the inner rotor with respect to the outer rotor. A passive piston, against which a return spring acts, abuts the upper surface of the inner rotor to provide the necessary sealing of the upper surface of the inner rotor with respect to the outer rotor. A control chamber supplied with pressurized working fluid, or another control mechanism, generates a force acting against the force of the return spring to move the inner rotor to, reduce the volumetric capacity of the pump. The gerotor pump can employ rotor assemblies of trochoidal, cycloidal, duo IC, duocentric, parachoid or other designs.

A gerotor pump in accordance with the present invention is believed to offer particular advantages over prior art variable capacity gerotor pumps in that it is radially compact, employs fewer and simpler parts than some prior art variable capacity gerotor pumps and has a substantially linear output response, allowing the effective establishment of equilibrium operating pressures at reduced volumetric flow rates. Further, in one embodiment, a gerotor pump in accordance with the present invention can be selectably operated at one of two or more equilibrium operating points. Non rotating sealing plates, referred to herein as passive and active pistons, allow conventional inlet and outlet ports to be employed, unlike the prior art, thereby avoiding the compromise of cavitation performance at high speeds.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
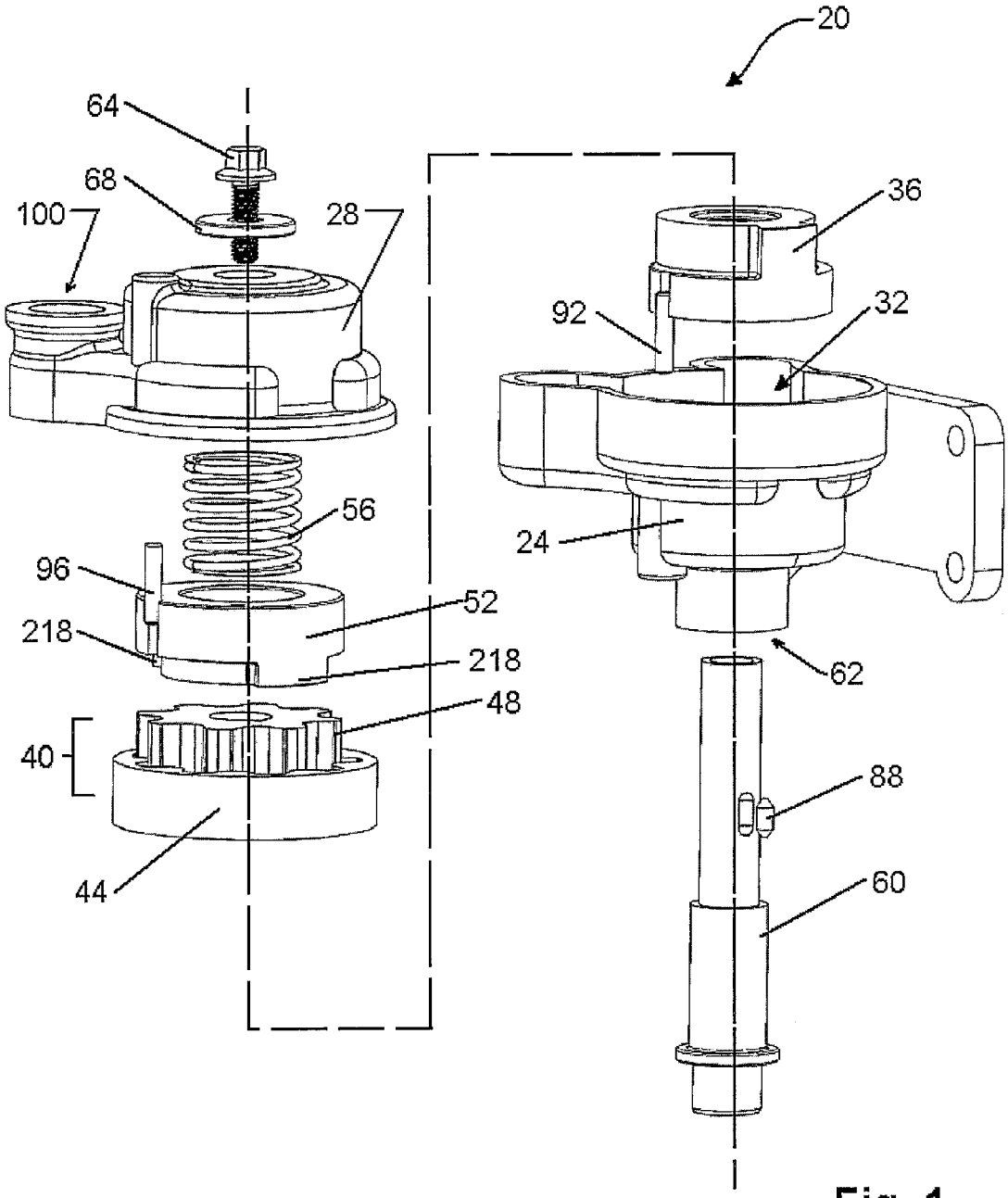
FIG. 1 shows an exploded side view of a variable capacity gerotor pump in accordance with the present invention.

A gerotor pump with variable volumetric capacity in accordance with the present invention is indicated generally at 20 in FIG. 1. As illustrated in FIGS. 1 through 4*b*, pump 20 includes a pump body formed from a housing 24 and a pump cover 28 which are mated together with screws, not shown, that extend through cover 28 into tapped bores within housing 24. When housing 24 and cover 28 are mated, they define a pump chamber 32 within which is an active piston 36, a rotor assembly 40 which comprises an outer rotor 44 and an inner rotor 48, a passive piston 52 and a spring 56.

As is known to those of skill in the art, gerotor pumps are positive displacement pumps with a rotor assembly comprising an inner rotor, having a number "n" of lobes, and an outer rotor having a number, n+1, of lobes. The inner rotor rotates within the outer rotor about an axis which is located eccentrically to the axis of the outer rotor, so the outer rotor is also rotated as the inner rotor turns.

The term "gerotor" is a contraction of "GEnerated ROTOR" as one of the rotors is formed or generated by the shape of the other. Gerotor pumps can employ a wide variety of rotor assembly designs, including trochoidal, cycloidal, duo IC, duocentric, parachoid and other designs.

A drive shaft 60 passes through a central bore 62 in housing 24 and extends through active piston 36, inner rotor 48, passive piston 52, return spring 56 and cover 28. A bolt 64, with a thrust washer 68, engages a threaded bore in the end of drive shaft 60 to hold drive shaft 60 in place when pump 20 is assembled.

Figure 2:
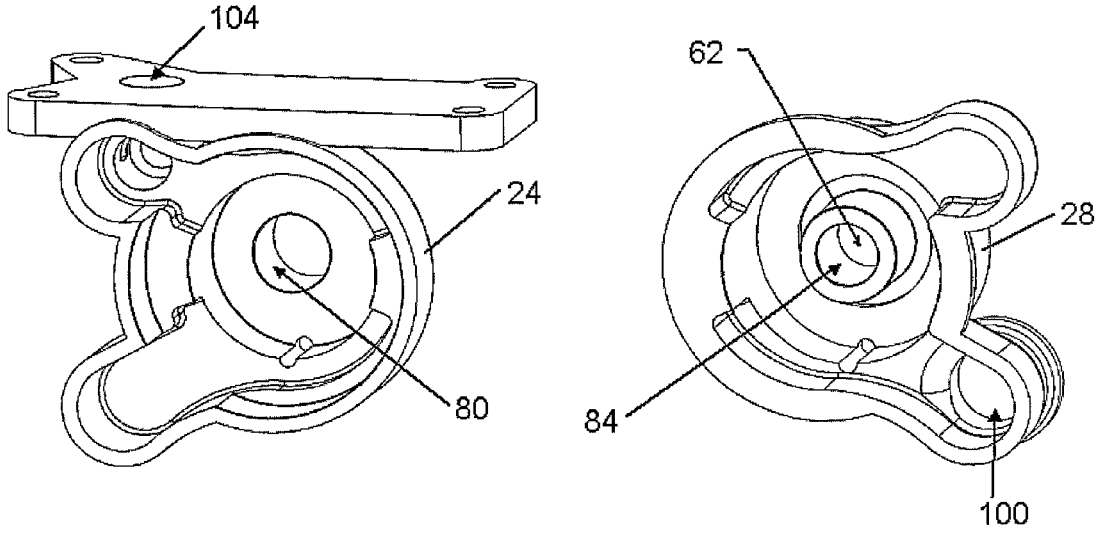
FIG. 2 shows the perspective view of interior of the pump housing and pump cover of the pump of FIG. 1.

Each of housing 24 and cover 28 include journalled bearing surfaces 80 and 84 respectively, best seen in FIG. 2, which allow drive shaft 60 to rotate. Drive shaft 60 includes a drive pin 88 which engages inner rotor 48 to ensure that inner rotor 48, and hence outer rotor 44, rotates with drive shaft 60. Drive pin 88 rides in a slot in inner rotor 48 which allows inner rotor 48 to be moved axially along drive shaft 60, as described below, while ensuring that inner rotor 48 turns with drive shaft 60.

Active piston 36 engages housing 24 via an anti-rotation pin 92 which rides in a slot in active piston 36 and in housing 24 to prevent rotation of active piston 36 in housing 24. Passive piston 52 engages cover 28 in a similar manner, via an anti-rotation pin 96 which rides in a slot in passive piston 52 and in cover 28, to prevent rotation of passive piston 52 in cover 28.

Pump cover 28 includes a pump inlet 100 through which working fluid to be pumped is introduced into pump chamber 32 and pump housing 24 includes a pump outlet 104 from which working fluid pressurized by pump 20 exits housing 24.

Figure 3A:
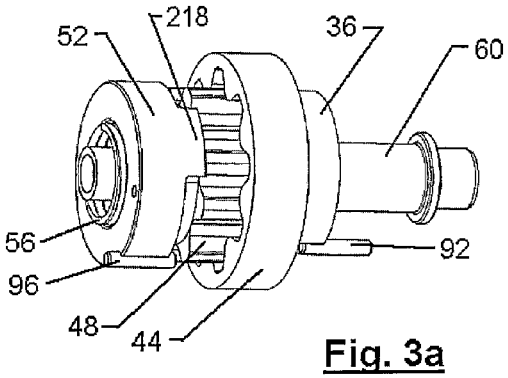
FIGS. 3*a* and 3*b* show perspective views of a pump rotor assembly of the pump of FIG. 1 in a reduced capacity configuration.
Figure 3B:
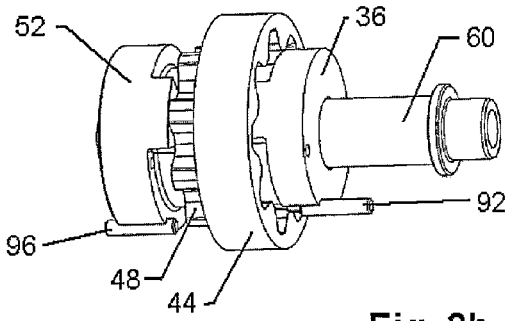
Figure 4A:
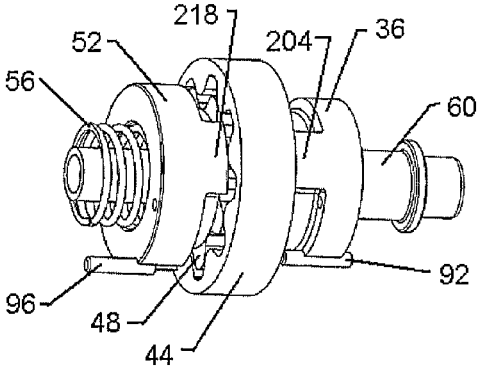
FIGS. 4*a* and 4*b* show perspective views of a pump rotor assembly of the pump of FIG. 1 in a maximum capacity configuration.
Figure 4B:
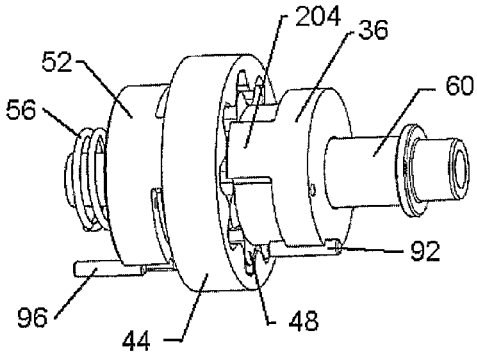

The pump rotor assembly of drive shaft 60, passive piston 52, return spring 56, outer rotor 44, inner rotor 48 and active piston 36 is shown in a reduced capacity configuration in FIGS. 3*a* and 3*b* and in a maximum capacity configuration in FIGS. 4*a* and 4*b*.

Figure 5A:
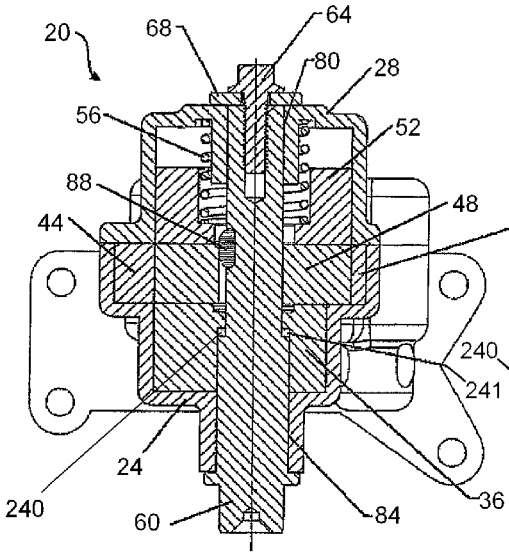
FIGS. 5*a* and 5*b* show side sections through the pump of FIG. 1 in a maximum capacity and minimum capacity configuration, respectively.
Figure 5B:
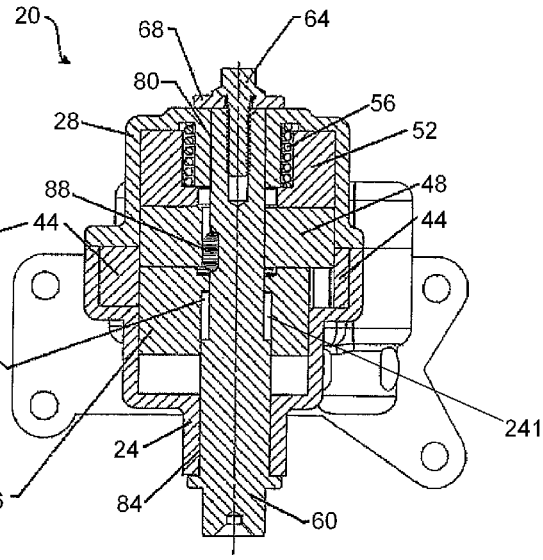
Figure 6:
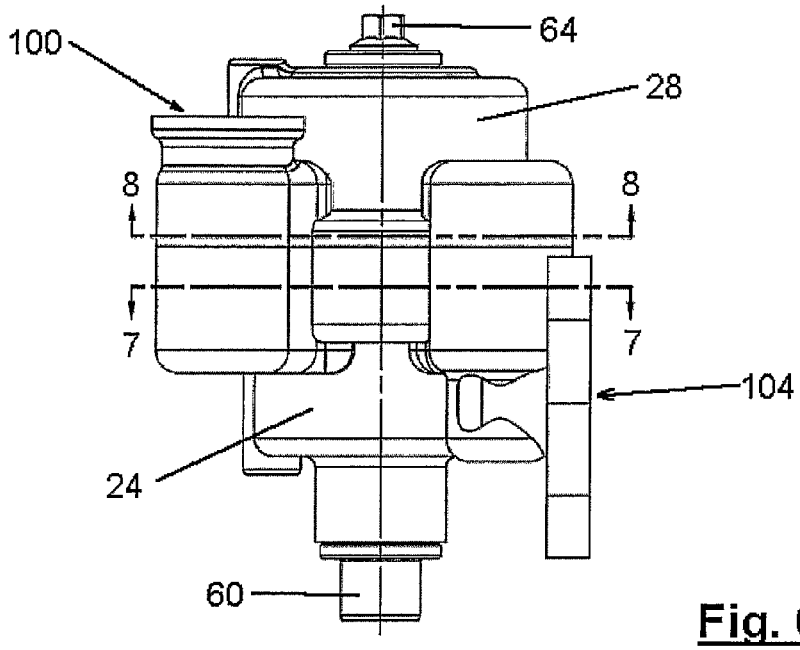
FIG. 6 shows a side view of the assembled pump of FIG. 1.

As illustrated, and best seen in FIGS. 5*a* and 5*b*, the axial position of outer rotor 44, with respect to drive shaft 60, is fixed, but inner rotor 48 can be moved axially along drive shaft 60 to alter the volumetric capacity of pump 20. Specifically, outer rotor 44 is retained axially in place by housing 24 and cover 28 while inner rotor 48 can move axially along drive pin 88 and drive shaft 60 between the maximum capacity position illustrated in FIG. 5*a* to the minimum capacity position illustrated in FIG. 5*b*.

In the maximum capacity position shown in FIG. 5*a*, inner rotor 48 is in the same axial plane as outer rotor 44 as in a conventional gerotor pump and the volume of the pumping chambers, defined between the lobes of inner rotor 48 and the lobes of outer rotor 44, change between a maximum volume and a minimum volume as rotor assembly 40 is rotated by drive shaft 60 and pump 20 has a maximum volumetric capacity proportional to this change.

In the minimum capacity position shown in FIG. 5*b*, inner rotor 48 extends axially approximately two-thirds of the way out of outer rotor 44. While the manner of providing the necessary seals for rotor assembly 40 in such a configuration will be described below, it will now be apparent to those of skill in the art that the maximum volume of the pumping chambers defined between the lobes of inner rotor 48 and outer rotor 44 is approximately one-third of the maximum volume of the pumping chambers in the configuration shown in FIG. 5*a*. Thus, the change in volume between the, now reduced, maximum volume and the minimum volume of the pumping chambers is reduced to approximately one-third of the change for the maximum capacity configuration of FIG. 5*a* and thus the volumetric capacity of pump 20 in the configuration of FIG. 5*b* is approximately one-third that of the maximum capacity obtained in FIG. 5*a*.

While not illustrated, it should now be apparent to those of skill in the art that pump 20 can be operated, as desired, at any intermediate axial position of inner rotor 48 between those positions illustrated in FIGS. 5*a* and 5*b* to obtain any desired volumetric capacity between the maximum and minimum capacities illustrated in the Figures to achieve the desired volumetric output and/or equilibrium operating pressure.

While in the illustrated embodiment the volumetric capacity of pump 20 can be varied from full capacity to a minimum capacity of about one third of the maximum capacity, the present invention is not limited to minimum capacities of one-third of the maximum capacity. In fact, pump 20 or the like can be configured to offer lower minimum capacities, approaching a zero volumetric capacity, limited only by the need to prevent inner rotor 48 from fully disengaging from outer rotor 44. As will be apparent to those of skill in the art, as a zero volumetric capacity can only be approached, in some circumstances such as cold starts, it may still be required to provide an over pressure relief valve or other mechanism in engines or other systems supplied by the pump to prevent excessive pressure.

As is known, the pumping chambers defined between the lobes of inner rotor 48 and outer rotor 44 must be sealed to substantially prevent working fluid from exiting the chambers except into the high pressure area of pump chamber 32. Conventionally, when the inner and outer rotors of a gerotor pump only operate in the same axial plane, the necessary sealing is achieved by upper and lower machined surfaces in the pump housing which abut the upper and lower surfaces of the rotor assembly.

In contrast, to accomplish the necessary sealing of the pumping chambers of pump 20, active piston 36 abuts the lower surface of inner rotor 48, and extends into outer rotor 44 when inner rotor 48 is axially displaced with respect to the plane of outer rotor 44, to provide the necessary seal between inner rotor 48 and outer rotor 44 at the lower surface of inner rotor 48.

Figure 7:
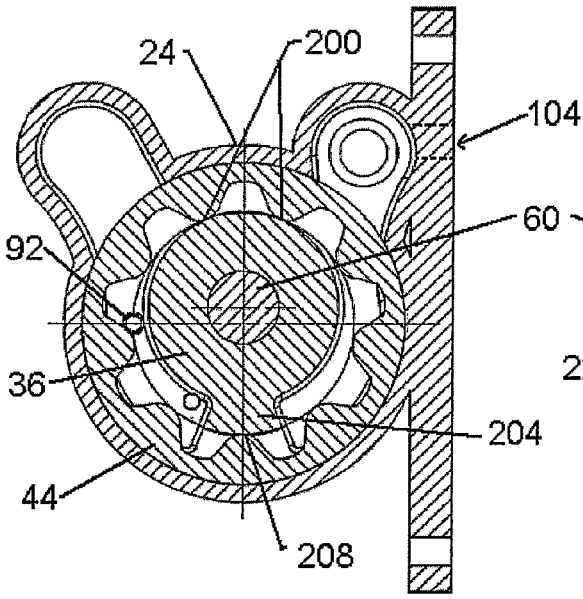
FIG. 7 shows a section taken through line 7-7 of FIG. 6.

FIGS. 4*b* and 7 best show the sealing function of active piston 36. As illustrated, in FIG. 7, active piston 36 includes a generally cylindrical surface with a radial center spaced from the center of outer rotor 44 such that the outer surface of active piston 36 abuts and seals the tips of the lobes of outer rotor 44 at positions 200. Active piston 36 further includes a sealing land 204, best seen in FIG. 4*b*, which seals the tip of the lobe of outer rotor 44 at position 208.

Figure 8:
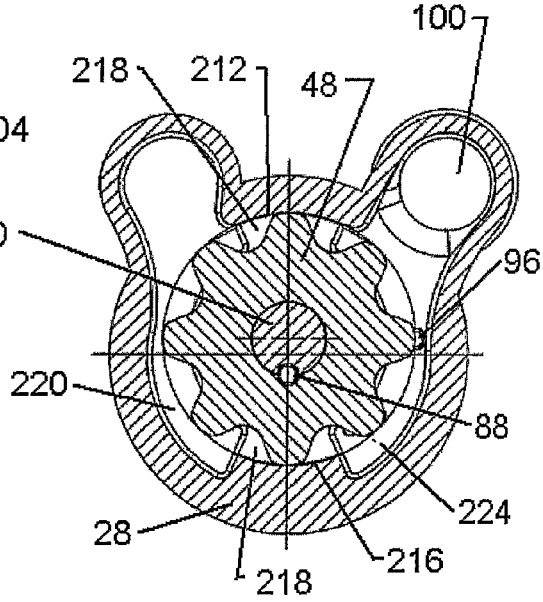
FIG. 8 shows a section taken through line 8-8 of FIG. 6.

As illustrated in FIG. 8, cover 28 includes inner surfaces at 212 and 216 against which the tips of the lobes of inner rotor 48 sealingly abut and passive piston 52 includes a pair of diametrically opposed lands 218 (also shown in FIGS. 1 and 3*a*) which the upper surface of the lobes of inner rotor 48 sealingly abut, and these sealing engagements separate the low pressure side 220 of rotor assembly 40 from the high pressure side 224.

Figure 9A:
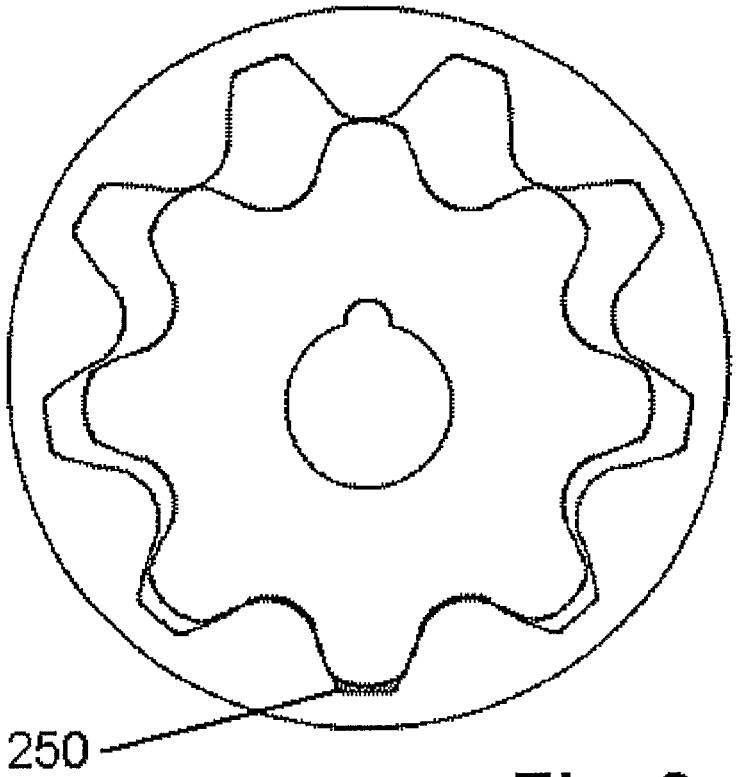
FIGS. 9*a* and 9*b* show, respectively, a rotor assembly design with a dead volume and a rotor assembly design without a dead volume.
Figure 9B:
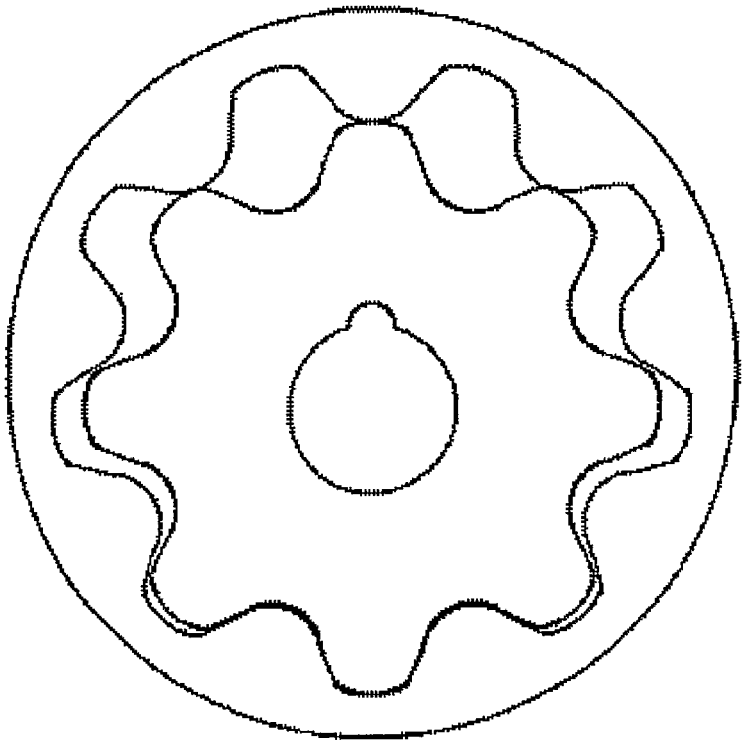

Further, as will be apparent, in addition to the above-described sealing features, the designed shape of the lobes of outer 44 and inner rotor 48 must be carefully selected to provide the necessary sealing. In particular, the design of the shape of the lobes of outer rotor 44 should be designed such that there is no dead volume in the root between adjacent lobes of outer rotor 44 when a lobe of inner rotor 48 is fully engaged into that root. FIG. 9*a* illustrates a rotor assembly with a dead volume 250, indicated by the hatched lines, and FIG. 9*b* shows a comparable design without a dead volume. Such dead volumes are often provided in prior art rotor designs to provide a volume in which a small amount of debris can allegedly be safely accommodated to avoid damage to the rotor lobes from the debris being ground between them.

As inner rotor 48 is moved axially along drive shaft 60 from the maximum capacity position, illustrated in FIGS. 4*a*, 4*b* and 5*a*, towards the minimum capacity position, illustrated in FIGS. 3*a*, 3*b* and 5*b*, active piston 36 extends into outer rotor 44 to maintain a seal at the lower face of inner rotor 48 between inner rotor 48 and outer rotor 44. Similarly, passive piston 52 is biased against the upper surface of inner rotor 48 by return spring 56 to maintain a seal at the upper surface of inner rotor 48 with respect to outer rotor 44 as inner rotor 48 is moved towards the minimum capacity configuration.

In the maximum capacity configuration, the tips of the lobes of inner rotor 48 abut the lobes of outer rotor 44 in a conventional manner and, as inner rotor 48 is moved axially towards the minimum capacity configuration, a portion of the lobes of inner rotor 48 continue to abut the lobes of outer rotor 44 and the remaining portion of the lobes of inner rotor 48 abut lands 212 and 216 in cover 28. In this manner, the seal between inner rotor 48 and outer rotor 44 is maintained as the capacity of pump 20 is changed.

In the illustrated embodiment, to alter the volumetric capacity of pump 20, a control chamber 240 (best seen in FIGS. 5*a* and 5*b*) is formed between drive shaft 60 and active piston 36. A feed bore, not shown, extends through active piston 36 to connect control chamber 240 with the high pressure side 220 of pump 20. In operation, as working fluid is pressurized by pump 20, pressurized working fluid is supplied to control chamber 240 through the feed bore and the pressure of the working fluid creates an axial force on inner rotor 48 which acts against the biasing force imparted on inner rotor 48, via passive piston 52, by return spring 56. If the force created within control chamber 240 exceeds the biasing force of return spring 56, inner rotor 48 will move from the maximum capacity configuration to a reduced capacity configuration. If pump 20 is operating in a reduced capacity configuration and the force created within control chamber 240 is less than the biasing force of return spring 56, inner rotor 48 will move from the reduced capacity configuration towards the maximum capacity configuration.

As will now be apparent to those of skill in the art, by appropriately selecting the area of control chamber 240 and the spring force of return spring 56, the volumetric capacity of pump 20 can be altered as required to establish an equilibrium operating pressure.

It is also contemplated that control chamber 240 can be supplied with pressurized working fluid from other sources, such as a working fluid gallery from the device being supplied by pump 20, via an axial bore from one end of drive shaft 60 and a radial feed bore to connect the axial bore to control chamber 240. Alternatively, control chamber 240 can be omitted and active piston 36 moved axially via a solenoid, or other electric or mechanical activation mechanism.

It is also contemplated that at least a second control chamber 241 can be provided between drive shaft 60 and active piston 36. In such a case, control chamber 240 can be supplied with pressurized working fluid as described above and the second control chamber 241 can be selectably supplied with pressurized working fluid via the above-mentioned axial bore and feeder bore through drive shaft 60. Each of control chamber 240 and the second control chamber 241 produce an axial force, which are additive, on inner rotor 48 to oppose the biasing force of return spring 56. As will be apparent, in such a configuration, pump 20 can be operated at a first equilibrium operating point by inhibiting the supply of pressurized fluid to the second control chamber 241, so that only control chamber 240 applies axial force to inner rotor 48, and can be operated at a second equilibrium operating point by allowing pressurized working fluid to be supplied to the second control chamber 241 so that both control chamber 240 and the second control 241 chamber apply axial force to inner rotor 48.

It is further contemplated that control chamber 240, or a second control chamber, can be formed between active piston 36 and housing 24, if desired.

A pump in accordance with the present invention is believed to offer particular advantages over prior art variable capacity gerotor pumps in that it is radially compact and it employs fewer and simpler parts than some prior art variable capacity gerotor pumps. Further, in one embodiment, a pump in accordance with the present invention can be selectably operated at one of two or more equilibrium operating points.

The above-described embodiments of the invention are intended to be examples of the present invention and alterations and modifications may be effected thereto, by those of skill in the art, without departing from the scope of the invention which is defined solely by the claims appended hereto.

We claim:

1. A variable capacity gerotor pump, comprising:

a pump housing defining a pump chamber, a pump inlet and a pump outlet;

an inner rotor;

an outer rotor rotatably located within the pump body, the inner rotor located within the outer rotor and the lobes of the inner rotor and outer rotor engaging, the outer rotor rotates about an axis which is eccentric from an axis of rotation of said inner rotor;

a drive shaft engaging the inner rotor to rotate the inner rotor and the outer rotor when the drive shaft is rotated, the inner rotor being axially displaceable along the drive shaft to alter the volumetric capacity of the pump;

an active piston including non-rotating sealing surfaces acting between the inner rotor and the outer rotor and the pump housing to create a high pressure region at the pump outlet and a low pressure region at the pump inlet when the drive shaft is rotated, the active piston abutting a surface of the inner rotor and including a substantially cylindrical surface having a radial center offset from the axis of rotation of the outer rotor to provide a seal between the surface of the inner rotor and the outer rotor, when the inner rotor is axially displaced, the cylindrical surface being in contact with two lobes of the outer rotor, and the active piston including a sealing land engaging another lobe of the outer rotor at a position substantially diametrically opposed to the two lobes; and a return spring biasing the inner rotor to a position of axial alignment with the outer rotor.

2. The variable capacity gerotor pump of claim 1 wherein the pump further includes a control chamber formed between the active piston and the drive shaft, the control chamber receiving pressurized working fluid from the pump outlet to create a force acting against the bias of the return spring to axially displace the inner rotor.

3. The variable capacity gerotor pump of claim 1 wherein the pump further includes a plurality of control chambers, each formed between the active piston and the drive shaft, each control chamber receiving pressurized working fluid from the pump outlet to create a force acting against the bias of the return spring to axially displace the inner rotor.

4. The variable capacity gerotor pump of claim 1 wherein the pump further includes a control mechanism to create a force acting on the active piston against the bias of the return spring to axially displace the inner rotor.

5. The variable capacity gerotor pump of claim 4 wherein the control mechanism is an electric solenoid.

6. The variable capacity gerotor pump of claim 1 wherein the inner and outer rotors are a trochoidal design.

7. The variable capacity gerotor pump of claim 1 wherein the inner and outer rotors are a cycloidal design.

8. The variable capacity gerotor pump of claim 1 further including a passive piston having diametrically opposed lands engaging the inner rotor.

9. The variable capacity gerotor pump of claim 1 wherein the inner and outer rotors are a duocentric design.

10. The variable capacity gerotor pump of claim 1 wherein the inner and outer rotors are a parachoid design.

11. The variable capacity gerotor pump of claim 1 wherein the lobes of the inner rotor and outer rotor engage without a dead volume therebetween.

12. A variable capacity gerotor pump, comprising:

a pump housing defining a pump chamber, a pump inlet and a pump outlet;

an inner rotor;

an outer rotor rotatably located within the pump housing, the inner rotor located within the outer rotor and being rotatable about an axis which is eccentric from an axis of rotation of the outer rotor;

a drive shaft fixed for rotation with the inner rotor, the inner rotor being axially displaceable along the drive shaft to alter the volumetric capacity of the pump;

an axially moveable, non-rotatable active piston being sealingly engageable with the inner rotor and a lobe of the outer rotor, the active piston including a convex sealing land engageable with another lobe of the outer rotor, wherein multiple additional lobes of the outer rotor are spaced apart from the active piston when the sealing land engages the another outer rotor lobe; and a return spring biasing the inner rotor to a position of axial alignment with the outer rotor.

13. The variable capacity gerotor pump of claim 12 wherein the active piston includes a substantially cylindrical surface having a radial center offset from an axis of rotation of the outer rotor that engages two lobes of the outer rotor, the convex sealing land having a radial center coaxially aligned with the outer rotor axis.

14. The variable capacity gerotor pump of claim 13 wherein the pump further includes a control chamber formed between the active piston and the drive shaft, the control chamber receiving pressurized working fluid from the pump outlet to create a force acting against the bias of the return spring to axially displace the inner rotor.

15. The variable capacity gerotor pump of claim 13 wherein the pump further includes a control mechanism to create a force acting on the active piston against the bias of the return spring to axially displace the inner rotor.

16. A variable capacity gerotor pump, comprising:

a pump including a housing defining a pump chamber, a pump inlet and a pump outlet;

an inner rotor;

an outer rotor rotatably positioned within the pump housing, the inner rotor being positioned within the outer rotor, and lobes of the inner rotor engaging lobes of the outer rotor, the outer rotor rotating about an axis offset from an axis of rotation of the inner rotor;

a drive shaft drivingly coupled to the inner rotor, the inner rotor being axially displaceable along the drive shaft to alter the volumetric capacity of the pump;

an axially moveable active piston including sealing surfaces being engageable with the inner rotor, the outer rotor and the pump housing;

a passive piston having diametrically opposed lands engaging the inner rotor and cylindrical surfaces of the housing to define a high pressure region at the pump outlet and a low pressure region at the pump inlet when the drive shaft is rotated; and a return spring biasing the inner rotor to a position of axial alignment with the outer rotor.

17. The variable capacity gerotor pump of claim 16 further including a pin coupled to the housing and positioned within a slot of the active piston to restrict rotation of the active piston.

18. The variable capacity gerotor pump of claim 17 further including another pin coupled to the housing and positioned within a slot of the passive piston to restrict rotation of the passive piston.

19. The variable capacity gerotor pump of claim 16 further including a drive pin captured within a pocket formed in the drive shaft, the drive pin being partially positioned within a slot of the inner rotor to transmit torque between and allow relative axial movement between the drive shaft and the inner rotor.

* * * * *